US007500820B2

(12) United States Patent
Inuzuka et al.

(10) Patent No.: US 7,500,820 B2
(45) Date of Patent: Mar. 10, 2009

(54) IMPELLER AND FUEL PUMP USING THE SAME

(75) Inventors: Yukio Inuzuka, Okazaki (JP); Kiyoshi Nagata, Nagoya (JP); Satoshi Yagi, Nishikasugai-gun (JP)

(73) Assignee: Denso Corporation, Kariya (JP)

( * ) Notice: Subject to any disclaimer, the term of this patent is extended or adjusted under 35 U.S.C. 154(b) by 697 days.

(21) Appl. No.: 11/097,250

(22) Filed: Apr. 4, 2005

(65) Prior Publication Data

US 2005/0226715 A1 Oct. 13, 2005

(30) Foreign Application Priority Data

Apr. 7, 2004 (JP) ..... 2004-113324
Feb. 17, 2005 (JP) ..... 2005-040769

(51) Int. Cl.
*F04D 5/00* (2006.01)

(52) U.S. Cl. ..... 415/55.1

(58) Field of Classification Search ..... 415/55.1, 415/55.2, 55.3, 55.4, 55.5, 55.6, 55.7
See application file for complete search history.

(56) References Cited

U.S. PATENT DOCUMENTS

| | | | | |
|---|---|---|---|---|
| 5,123,809 | A | 6/1992 | Ito | |
| 5,328,325 | A | 7/1994 | Strohl et al. | 415/55.1 |
| 5,395,210 | A | 3/1995 | Yamazaki et al. | 415/55.1 |
| 5,407,318 | A | 4/1995 | Ito et al. | 415/55.1 |
| 5,536,139 | A | 7/1996 | Yamazaki et al. | 415/55.1 |
| 5,642,981 | A * | 7/1997 | Kato et al. | 415/55.1 |
| 5,697,152 | A | 12/1997 | Yamazaki et al. | 29/889.21 |
| 6,439,833 | B1 * | 8/2002 | Pickelman et al. | 415/55.1 |
| 6,497,552 | B2 * | 12/2002 | Kobayashi et al. | 415/55.1 |
| 6,846,155 | B2 * | 1/2005 | Takami et al. | 415/55.1 |
| 7,037,066 | B2 * | 5/2006 | Moss | 415/55.1 |

FOREIGN PATENT DOCUMENTS

| | | |
|---|---|---|
| JP | 3-81596 | 4/1991 |
| JP | 7-217588 | 8/1995 |
| JP | 2004-92599 | 3/2004 |

OTHER PUBLICATIONS

Chinese Office Action (with English translation) dated Dec. 25, 2005.

* cited by examiner

*Primary Examiner*—Edward Look
*Assistant Examiner*—Nathaniel Wiehe
(74) *Attorney, Agent, or Firm*—Nixon & Vanderhye PC

(57) ABSTRACT

The outer periphery of a disc-shaped impeller is surrounded with an annular portion. Vane grooves are formed on the inner circumferential side of the annular portion on both sides in the axial direction. The vane grooves, which are adjacent to each other, are partitioned with a partition wall that is bent at the substantially center in the axial direction. The partition wall is bent to the rear side relative to the rotative direction. The vane grooves, which are formed on both sides in the axial direction, are partitioned with a wall from each other partially on the radially inner side thereof. A partition wall, which is arranged on the rear side of the vane groove relative to the rotative direction, has a fore face that is on the fore side of the partition wall relative to the rotative direction. The fore face is an inclined flat face that is inclined to the rear side relative to the rotative direction, as extending to the radially outer side.

20 Claims, 9 Drawing Sheets

IMPELLER AND FUEL PUMP USING THE SAME

CROSS REFERENCE TO RELATED APPLICATIONS

This application is based on and incorporates herein by reference Japanese Patent Applications No. 2004-113324 filed on Apr. 7, 2004 and No. 2005-40769 filed on Feb. 17, 2005.

FIELD OF THE INVENTION

The present invention relates to an impeller and a fuel pump using the Impeller. The impeller has vane grooves formed along the rotative direction thereof such that the impeller rotates to pressurize fuel in a pump passage. The pump passage is formed along the vane groove.

BACKGROUND OF THE INVENTION

Conventionally, fuel pumps are disclosed in JP-A-3-81596, JP-B2-2962828 (U.S. Pat. No. 5,328,325), JP-A-3-175196 (U.S. Pat. Nos. 5,697,152, 5,536,139 , 5,395,210), JP-A-6-229388 (U.S. Pat. No. 5,407,318), JP-A-7-217588. In the conventional fuel pump, multiple vane grooves are formed in a disc-shaped impeller along the rotative direction thereof. The vane grooves, which are adjacent to each other in the rotative direction, are partitioned with a partition wall. The impeller rotates to pressurize fuel in a pump passage formed along the vane grooves.

The impeller rotates, so that swirl-flow energy is generated in fluid. The swirl-flow energy is used for pressurizing fluid in the pump passage. When fluid flows from the pump passage into the radially inner side of the vane groove, swirl-flow energy of fluid decreases. As a result, a component of velocity of swirl flow along the rotation axis decreases, and the flow direction of fluid is approximated to the rotative direction. As described in JP-A-3-81596, U.S. Pat. No. 5,328,325, a partition wall, which is located on the rear side of a vane groove in the rotative direction, has a fore face on the fore side in the rotative direction, and the fore face is a flat face that is along the radial direction thereof. In this structure, the swirl flow does not pass through the grove vane along the fore face of the partition wall, and the swirl flow collides against the fore face of the partition wall in a large angle. The colliding force works in the direction opposite to the rotative direction of the impeller, and rotation of the impeller is disturbed.

SUMMARY OF THE INVENTION

In view of the foregoing problems, it is an object of the present invention to produce an impeller for a fuel pump, in which fuel is capable of smoothly flowing into a groove vane, and to produce a fuel pump using the impeller.

According to the present invention, an impeller for a fuel pump internally forms a pump passage along a rotative direction of the impeller. The impeller internally forms the pump passage on both sides in the axial direction of the impeller. The impeller rotates to pressurize fuel in the pump passage. The impeller defines multiple vane grooves along the rotative direction. The vane grooves are respectively on both sides in the axial direction of the impeller. The vane grooves communicates with the pump passage. The impeller includes multiple partition walls. Each partition wall partitions the vane grooves, which are adjacent to each other in the rotative direction. Each partition wall includes a fore face on the fore side relative to the rotative direction. The fore face includes an inclined face that is inclined to a rear side relative to the rotative direction at least on a radially inner side thereof. The inclined face is inclined by an inclination angle $\alpha$ that is equal to or less than 45°.

The fore face on the radially outer side of the inclined face is inclined to the fore side relative to the rotative direction with respect to the inclined face. The fore face has a flat face on the radially outer side of the inclined face, and the flat face is defined along the radial direction.

The partition wall has a rear face on the rear side relative to the rotative direction. The rear face is inclined on the radially inner side to the rear side relative to the rotative direction.

The vane groove has a length L0 in the radial direction, and the inclined face has a length L1 in the radial direction. The length L0 and the length L1 have a relationship such that L1/L0 is equal to or greater than 0.3.

L1/L0 may be equal to or greater than 0.5. L1/L0 may be equal to or less than 0.75. The impeller further includes an annular portion that connects to the partition walls. The annular portion surrounds the vane groove on the radially outer side.

Each partition wall includes the fore face on the fore side relative to the rotative direction. Each partition wall includes the rear face on the rear side relative to the rotative direction. The annular portion has the inner peripheral face. The fore face of the partition wall on the radially outer side and the inner peripheral face of the annular portion define an intersection, which is in an angular shape, therebetween. The rear face of the partition wall on the radially outer side and the inner peripheral face of the annular portion define an intersection, which is in an angular shape, therebetween.

The vane groove has an inner peripheral face on the radially inner side. The fore face of the partition wall on the radially inner side and the inner peripheral face of the vane groove define an intersection, which is in an angular shape, therebetween. The rear face of the partition wall on the radially inner side and the inner peripheral face of the vane groove define an intersection, which is in an angular shape, therebetween.

A fuel pump includes a motor portion, the impeller, and a case member. The impeller is rotated by driving power generated by the motor portion. The case member rotatably accommodates the impeller. The case member defines the pump passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
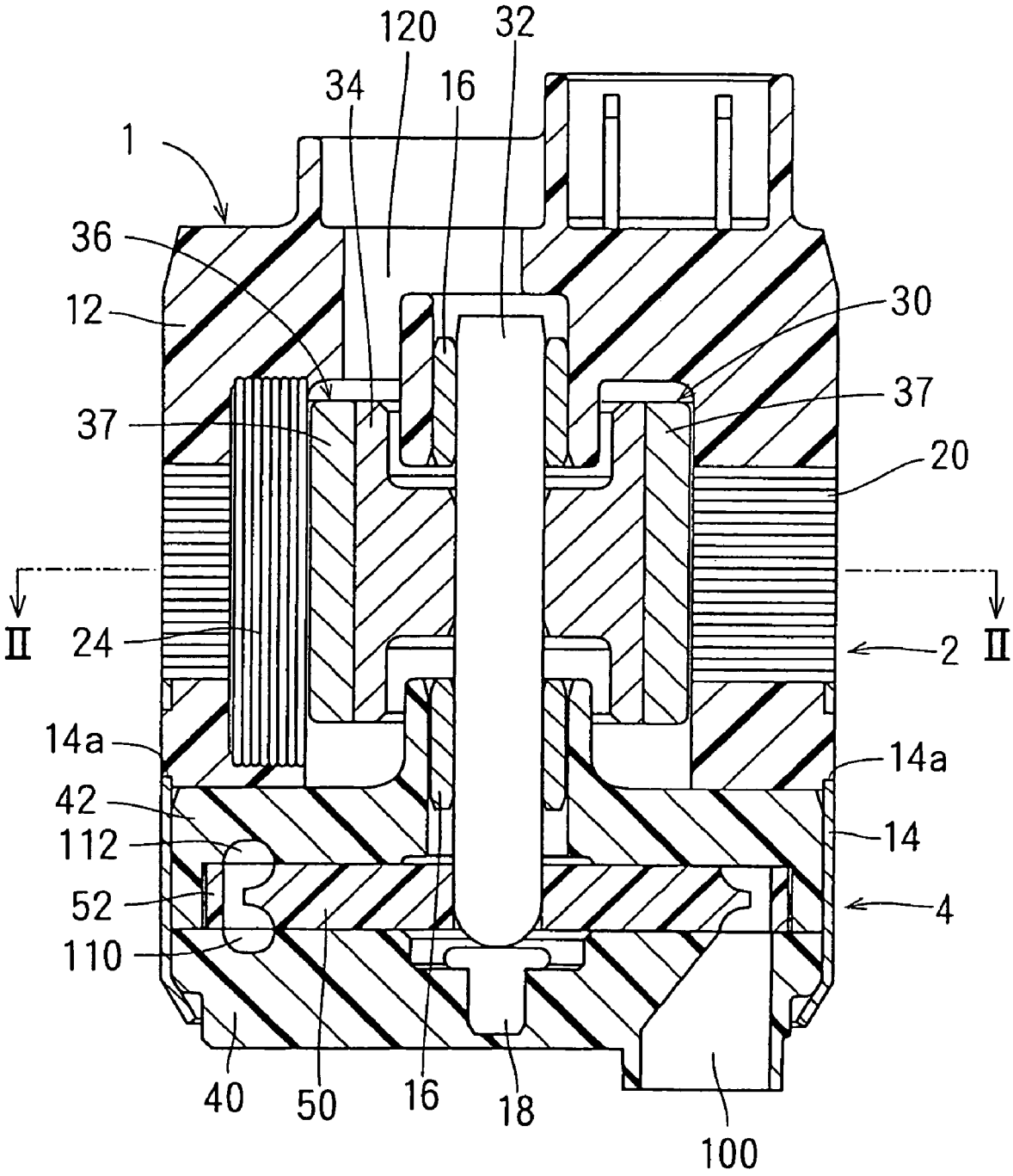
FIG. 1 is a cross sectional side view showing a fuel pump according to the first embodiment of the present invention.
Figure 2:
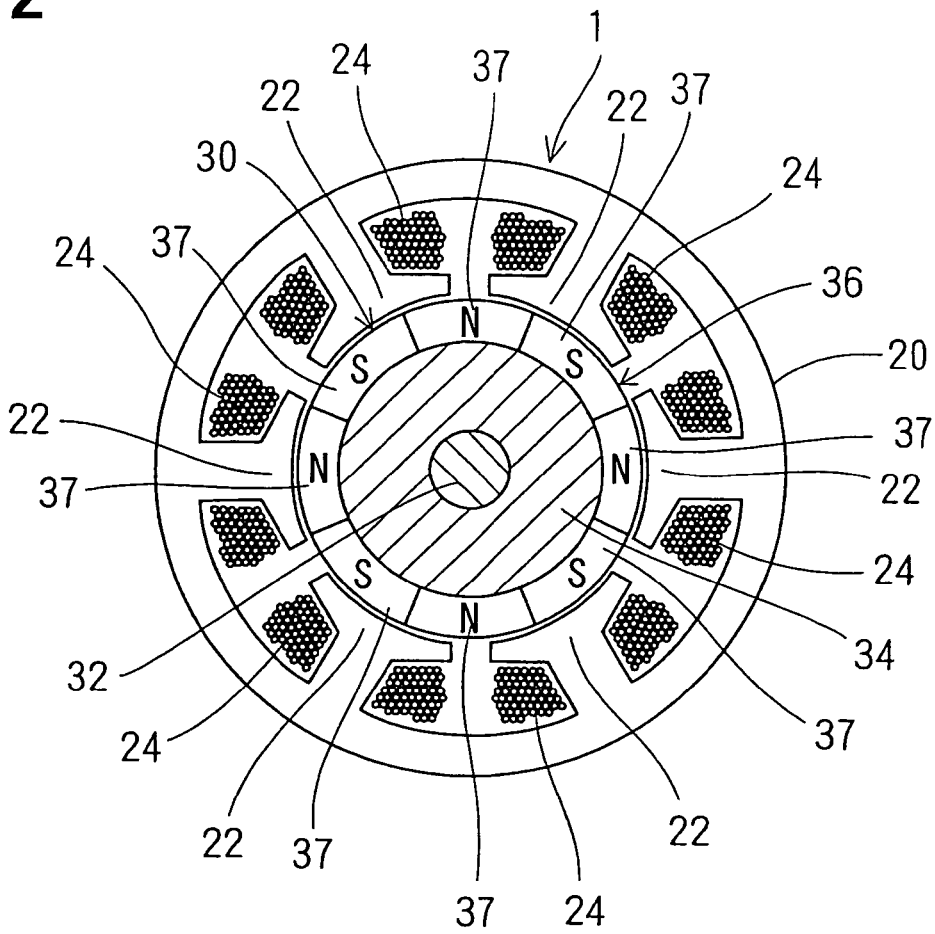
FIG. 2 is a cross-sectional view taken along the line II-II in FIG. 1.

As shown in FIGS. 1, 2, a fuel pump 1 is an in-tank type pump that is accommodated in a fuel tank of a vehicle, for example. The fuel pump 1 supplies fuel in the fuel tank to an engine, which is a fuel consuming apparatus. The fuel pump 1 has a motor portion 2 and a pump portion 4. The motor portion 2 has a rotor 30 that rotates to operate the pump portion 4 that pressurizes fuel drawn from the fuel tank. The fuel pump 1 rotates by 4000 to 15000 rpm, so that the fuel pump 1 discharges fuel by 7 to 300 L/h. The fuel pump 1 has the diameter that is between 10 an 50 mm.

The motor portion 2 has a stator core 20, a coil 24, and the rotor 30. The stator core 20 is formed such that magnetic steel plates are stacked in the axial direction. As shown in FIG. 2, six teeth 22, which protrude to the center of the motor portion 2, are arranged in the circumferential direction at regular intervals. A coil 24 is wound around each tooth 22. The stator core 20 and the coil 24 are molded within a resinous housing 12. A metallic housing 14 is insert molded in the resinous housing 12, such that the metallic housing 14 is crimped onto a suction cover 40. Resin of the resinous housing 12 is filled into multiple through holes 14*a* that are formed in the metallic housing 14.

The rotor 30 includes a shaft 32, a rotative core 34, and a permanent magnet 36. The permanent magnet 36 is formed in a cylindrical shape with one member, and is arranged on the outer circumferential side of the rotative core 34. The permanent magnet 36 is formed with eight magnetic pole portions 37 that are arranged in the rotative direction. The eight magnetic pole portions 37 are magnetized such that each magnetic pole portion 37 forms a magnetic pole that is different from each other in the rotative direction. Each magnetic pole opposes to the stator core 20 on the outer circumferential side.

The pump portion 4 includes the suction cover 40, a discharge cover 42, and an impeller 50. The suction cover 40 and the discharge cover 42 are case members that rotatably accommodate the impeller 50. The discharge cover 42 is interposed between the resinous housing 12 and the suction cover 40 that are fixed by the metallic housing 14. The impeller 50 rotates, and draws fuel from a suction port 100 of the suction cover 40. The fuel is pressurized in pump passages 110, 112, which are formed in the suction cover 40 and the discharge cover 42 along the outer periphery of the impeller 50, and the fuel is discharged from a discharge port 120 after passing between the rotor 30 and the stator core 20.

Figure 3:
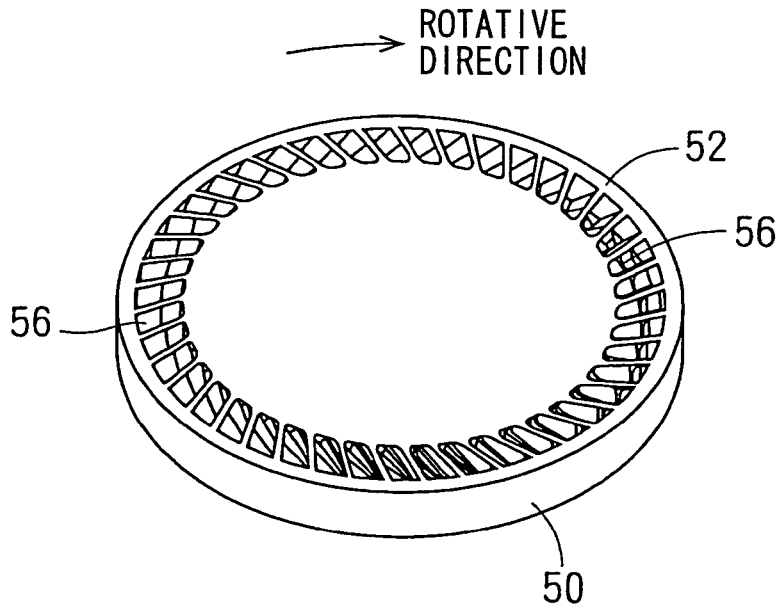
FIG. 3 is a perspective view showing an impeller according to the first embodiment.

Next, the structure of the impeller 50 is described in detail. As shown in FIG. 3, the impeller 50 is formed in a disc shape. The outer circumferential periphery of the impeller 50 is surrounded by an annular portion 52. Vane grooves 56 are formed in the impeller 50 on the inner circumferential side of the annular portion 52. The vane grooves 56 are formed in the impeller 50 on both sides in the axial direction.

Figure 4A:
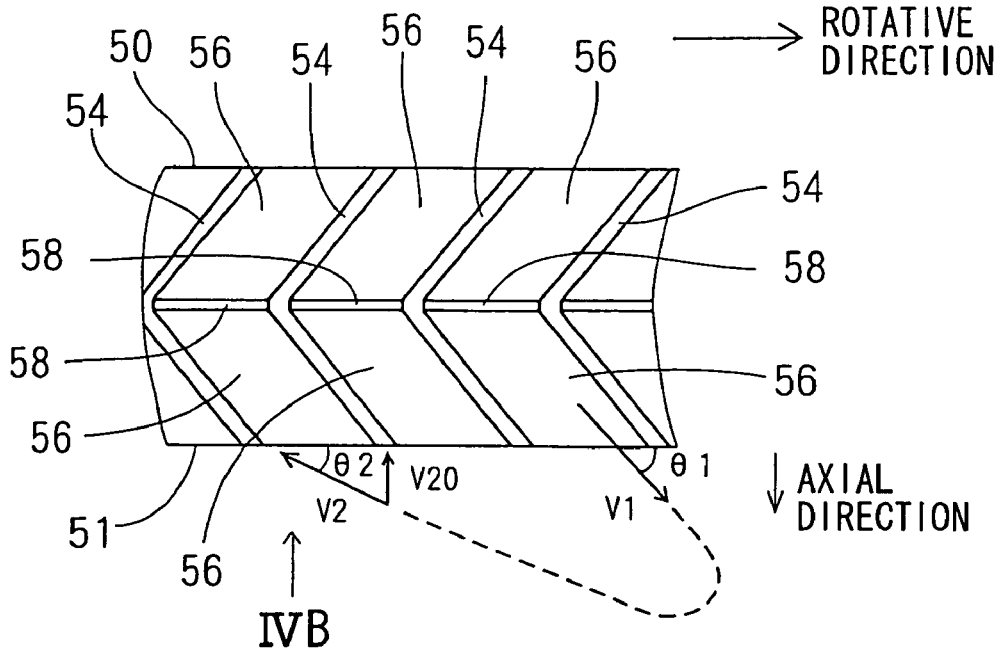
FIG. 4A is a cross sectional side view showing the impeller according to the first embodiment.
Figure 4B:
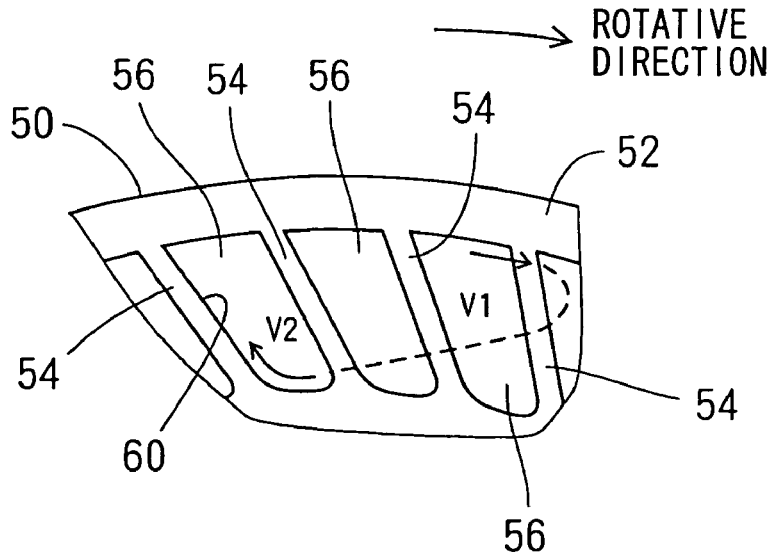
FIG. 4B is a front view when being viewed from the arrow IVB in FIG. 4A.
Figure 5:
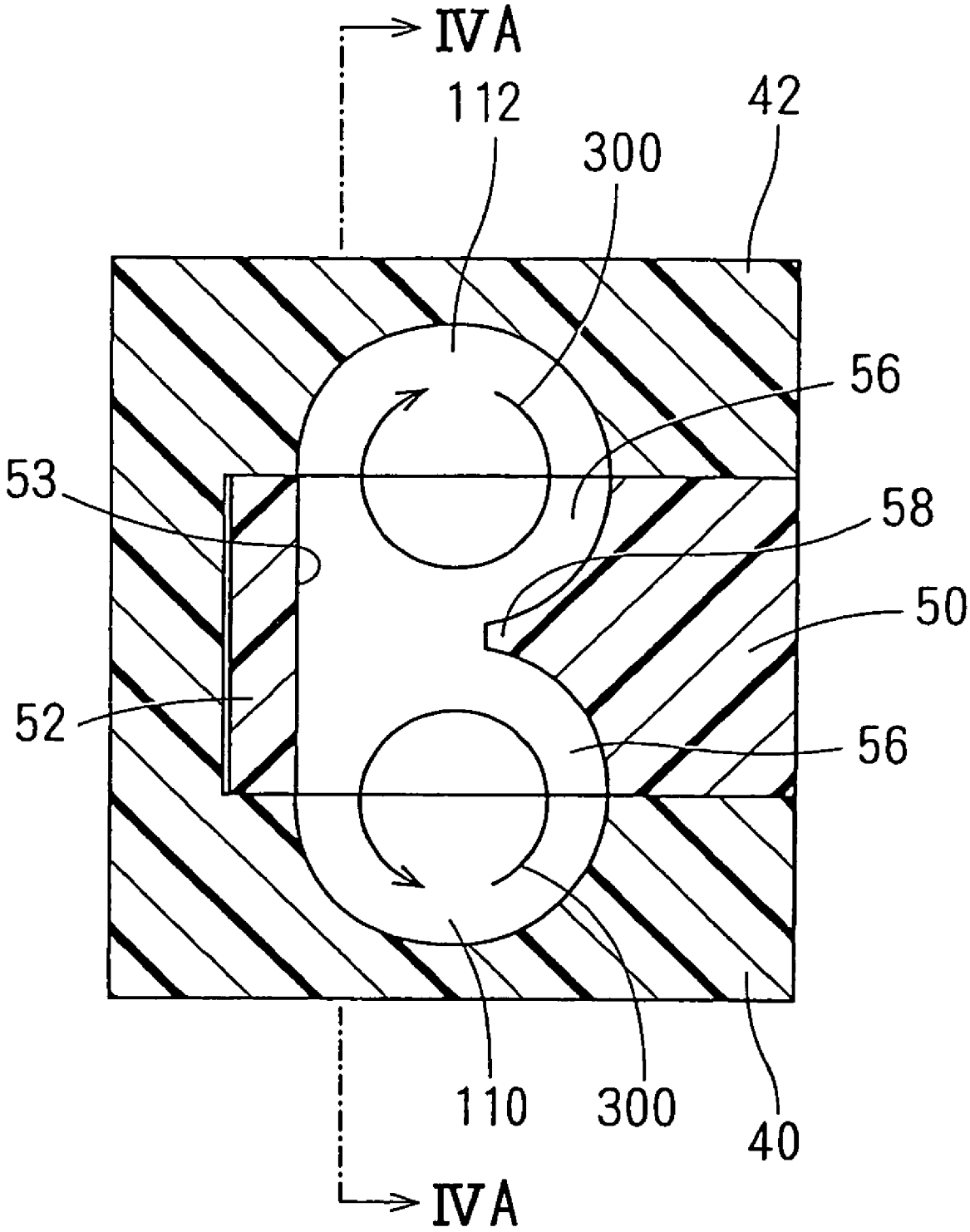
FIG. 5 is a cross sectional side view showing a vane groove of the impeller according to the first embodiment.

FIG. 4A is a cross sectional side view taken along the line IVA-IVA in FIG. 5. As shown in FIGS. 4A, 4B, the vane grooves 56, which are adjacent to each other in the rotative direction, are partitioned with a partition wall 54. The partition wall 54 is bent at a substantially center thereof in the axial direction. The partition wall 54 is bent toward the rear side in the rotative direction.

As shown in FIG. 5, the vane grooves 56, which are adjacent to each other in the axial direction, are partially partitioned with the wall 58 on the radially inner side of vane grooves 56. However, the vane grooves 56, which are adjacent to each other in the axial direction, are communicated with each other on the radially outer side of vane grooves 56. The wall 58 is formed in a smooth concave shape from the radially inner side to the radially outer side thereof. The wall 58 is smoothly concave from axially both end sides to the axially center side thereof. Thereby, fuel flows into the vane grooves 56 along the concave face of the wall 58, and the fuel forms swirl flow 300 on both sides of the vane grooves 56 in the axial direction.

Figure 6:
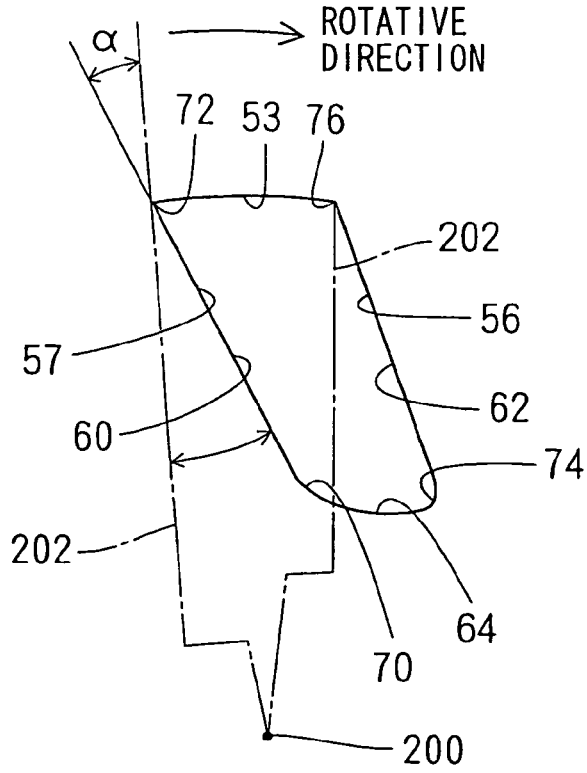
FIG. 6 is a front view showing the vane groove according to the first embodiment.

As shown in FIG. 6, each vane groove 56 has an inner face 57 that is defined by an inner face 53 of the annular portion 52, a fore face 60 on the fore side of the partition wall 54 in the rotative direction, a rear face 62 on the rear side of the partition wall 54 in the rotative direction, and an inner face 64. The inner face 64 is formed on the radially inner side of the vane groove 56 along the rotative direction. The fore face 60, which is an inclined flat face, is formed on the rear side of the vane groove 56 in the rotative direction. The fore face 60 of the partition wall 54 and the inner face 64 of the vane groove 56 form an edge portion (intersection) 70, which is in an arc shape, in the intersection therebetween. The fore face 60 of the partition wall 54 and the inner face 53 of the annular portion 52 form an edge portion (intersection) 72, which is in an angular shape, in the intersection therebetween. The fore face 60 of the partition wall 54 is inclined toward the rear side in the rotative direction, as extending to the radially outer side. The fore face 60 is inclined toward the rear side by an inclination angle α with respect to an imaginary line 202. The imaginary line 202 radially extends to the radially outer side of the vane groove 56. That is, the fore face 60 of the partition wall 54 is inclined on the radially inner side thereof toward the fore side relative to the rotative direction by an inclination angle α with respect to the imaginary line 202. The inclination angle α is equal to or less than 45°.

The rear face 62 is a flat face that is formed on the rear side of the partition wall 54 in the rotative direction. The rear face 62 is arranged on the fore side of the vane groove 56 in the rotative direction. The rear face 62 is inclined toward the rear side in the rotative direction, as extending to the radially outer side thereof, similarly to the fore face 60. That is, the rear face 62 is inclined on the radially inner side thereof toward the fore side relative to the rotative direction. The rear face 62 of the partition wall 54 and the inner face 64 of the vane groove 56 form an edge portion (intersection) 74, which is in an arc-shape, in the intersection therebetween. The rear face 62 of the partition wall 54 and the inner face 53 of the annular portion 52 form an edge portion (intersection) 76, which is in an angular shape, in the intersection therebetween. As show in FIGS. 4A to 6, the impeller 50 rotates, so that fuel respectively flows from the radially outer side of the vane groove 56 into the pump passages 110, 112. The fuel respectively flows into the radially inner side of the vane groove 56, which is located on the rear side in the rotative direction. Fuel repeatedly flows out of the vane groove 56, and repeatedly flows into the vane groove 56, so that the fuel in the pump passages 110, 112 is pressurized by energy of the fuel that forms the swirl flow 300.

As shown in FIGS. 4A, 4B, fuel flows from the radially outer side of the vane groove 56 into the pump passages 110, 112 at velocity V1, and the fuel consumes energy to pressurize fuel in the pump passages 110, 112. When the fuel flows into the vane groove 56 on the rear side in the rotative direction at velocity V2, a component of velocity of the fuel along the axial direction decreases. When fuel flows out of the radially outer side of the vane groove 56, the flow of fuel and an axially end face 51 of the impeller 50 define an angle θ1 therebetween. When the fuel flows into the radially inner side of the vane groove 56, the flow of fuel and the end face 51 of the impeller 50 define an angle θ2 therebetween. The angle θ1 is greater than the angle θ2. That is, the flow direction of fuel is approximated to the rotative direction, when the fuel flows into the radially inner side of the vane groove 56 at the velocity V2 (FIG. 4A).

In the first embodiment, the fore face 60 of the partition wall 54, which is on the rear side of the vane groove 56 in the rotative direction, is the inclined flat face that is inclined on the radially outer side thereof toward the rear side in the rotative direction. Thereby, an angle of collision between flow of fuel flowing into the vane groove 56 and the fore face 60 is decreased, so that collision force, which is applied to the impeller 50 in the direction opposite to the rotative direction due to collision of fuel, is decreased as much as possible. Furthermore, the edge portion 70 between the fore face 60 of the partition wall 54 and the inner peripheral face 64 of the vane groove 56 is formed in an arc shape, so that fuel smoothly flows into the vane groove 56 from the edge portion 70 toward the fore face 60 (FIG. 4B). Thereby, force, which is applied in the direction opposite to the rotative direction by fuel flowing into the vane groove 56, can be decreased, so that pump efficiency can be enhanced. Here, the pump efficiency is expressed as (P·Q)/(T·N). Torque of the impeller 50 is T, revolution is N, pressure of fuel discharged from the pump portion 4 is P, and a discharge amount of fuel is Q.

The rear face 62 is formed on the rear side of the partition wall 54 in the rotative direction. The rear face 62 is arranged on the fore side of the vane groove 56 in the rotative direction. The rear face 62 is inclined toward the rear side in the rotative direction as the rear face 62 extends to the radially outer side thereof, corresponding to the fore face 60. Thereby, the vane groove 56 can be restricted from being changed in volume due to inclination of the fore face 60, and the vane groove 56 can be restricted from being reduced in total volume.

The edge portions (intersections) 72, 76, which are defined among the fore face 60, rear face 62, and the inner peripheral face 53, are in the angular shapes. Thereby, volume of the vane groove 56 and an area, through which swirl flow passing into the vane groove 56, can be enhanced as much as possible, compared with a structure, in which the edge portions 72, 76 are in arc-shapes. Thus, an amount of fuel flowing through the vane groove 56 can be increased as much as possible, and energy of swirl flow can be enhanced. Simultaneously, energy, which is transmitted to fuel in the pump passages, can be further enhanced.

The edge portions 72, 76 are preferably in the angular shapes. However, when an R need to be formed due to constraints of manufacturing or the like, R is preferably equal to or less than 0.5 mm. In the first embodiment, the annular portion 52 covers the radially outer side, i.e., outer periphery of the vane groove 56, and a pump passage is not formed on the outer circumferential side of the impeller 50. As a result, differential pressure of fuel, which is pressurized in the pump passage, in the rotative direction is not directly applied to the impeller 50 in the radial direction, so that force, which is applied to the impeller 50 in the radial direction, decreases. Thereby, the impeller 50 can be protected from being misaligned in rotation center thereof, so that the impeller 50 can smoothly rotate.

Second Embodiment

Figure 7:
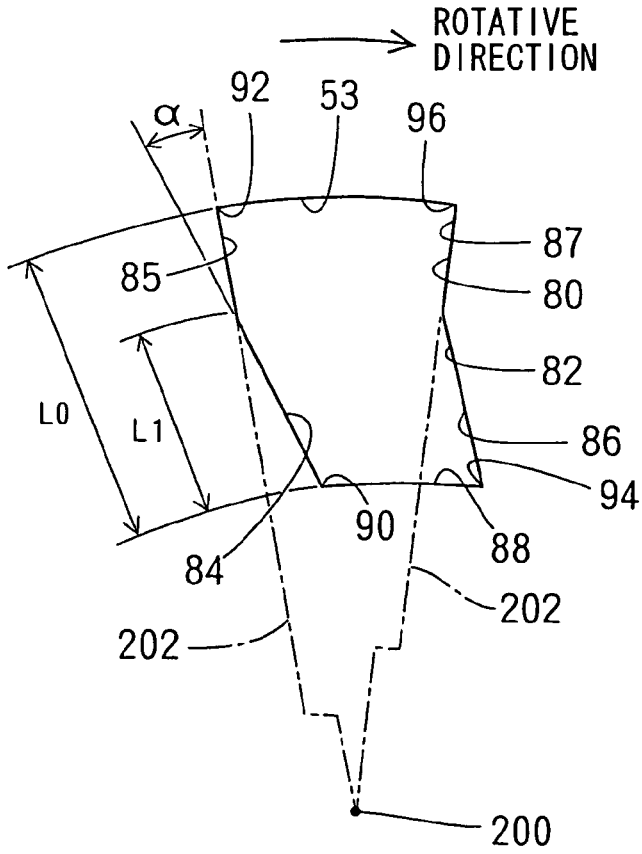
FIG. 7 is a front view showing a vane groove according to the second embodiment of the present invention.
Figure 8A:
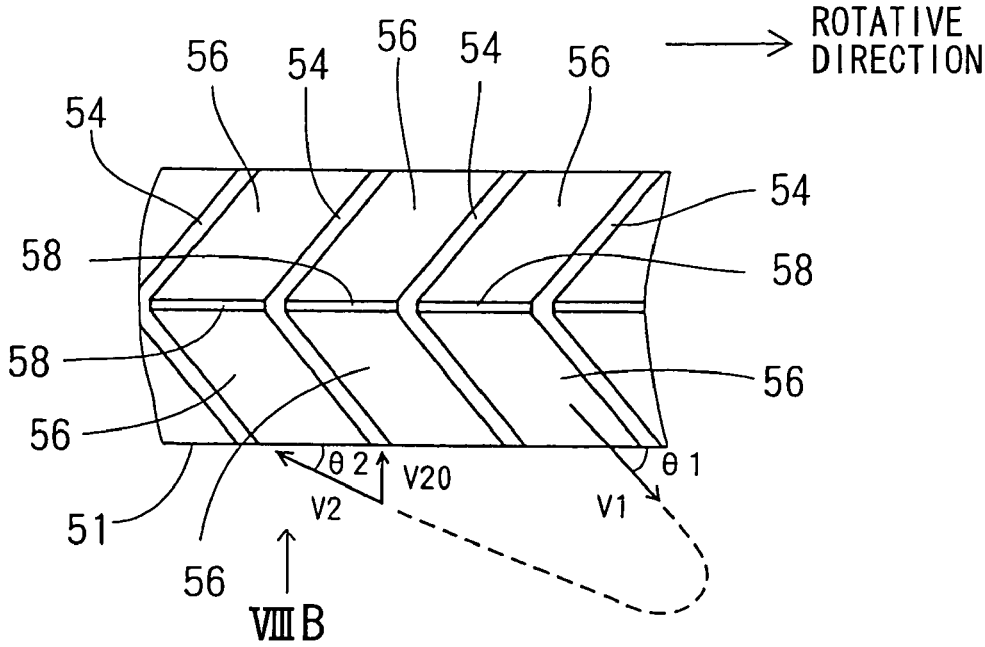
FIG. 8A is a cross sectional side view showing an impeller according to the second embodiment.
Figure 8B:
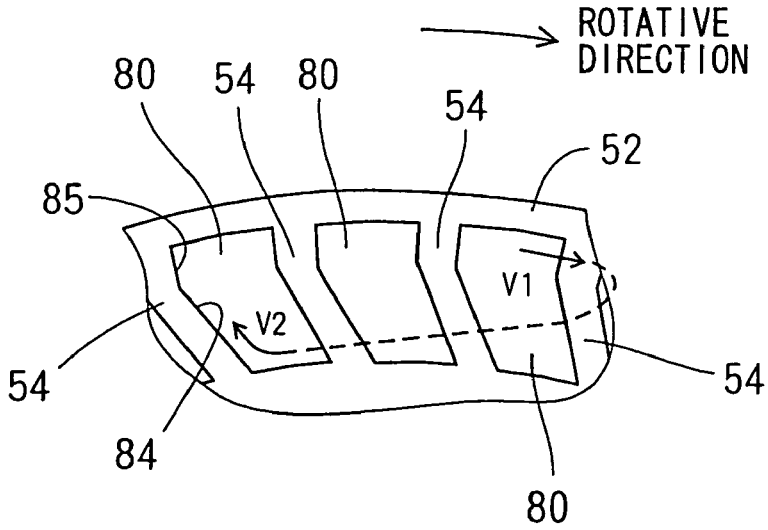
FIG. 8B is a front view when being viewed from the arrow VIIIB in FIG. 8A.

The second embodiment of the present invention is shown in FIGS. 7, 8A, 8B. In the second embodiment, only the shape of a vane groove 80 is different from shape of the vane groove 56 in the first embodiment. Other structures of the fuel pump including the impeller are substantially the same as those of the first embodiment.

As shown in FIG. 7, each vane groove 80 has an inner peripheral face 88 that is defined by an inner peripheral face 53 of the annular portion 52, fore faces 84, 85 on the fore side of the partition wall 54 in the rotative direction, rear faces 86, 87 on the rear side of the partition wall 54 in the rotative direction, and an inner peripheral face 88. The inner peripheral face 88 of the vane groove 80 is formed on the radially inner side along the rotative direction. The fore face 84, which is an inclined plane, is an inclined flat face that is formed on the rear side of the vane groove 80 in the rotative direction. The fore face 84 is inclined on the radially outer side thereof toward the rear side in the rotative direction. The fore face 84 is inclined on the radially outer side thereof toward the rear side in the rotative direction by the inclination angle α with respect to an imaginary line 202. The imaginary line 202 radially extends from the center 200 of the impeller 50 to the radially outer side. The fore face 84 and the inner peripheral face 88 form an edge portion (intersection) 90, which is in an angular shape, in the intersection therebetween. The fore face 85 is a flat face that is formed on the radially outer side of the fore face 84, such that the fore face 85 is continued from the fore face 84. The fore face 85 is formed along the radial direction, and is inclined to the fore side in the rotative direction with respect to the fore face 84. Therefore, the total fore face of the partition wall 54, which includes the fore faces 84, 85, is bent to the fore side in the rotative direction to be in a reentrant shape.

The rear face 86 is a flat face that is formed on the fore side of the vane groove 80 in the rotative direction. The rear face 86 is formed on the radially inner side. The rear face 86 is inclined on the radially outer side thereof toward the rear side in the rotative direction. That is, the rear face 86 is inclined on the radially inner side thereof toward the fore side relative to the rotative direction. The rear face 86 and the inner peripheral face 88 form an edge portion (intersection) 94, which is in an angular shape, in the intersection therebetween. The rear face 87 and the inner peripheral face 53 form an edge portion (intersection) 96, which is in an angular shape, in the intersection therebetween. The rear face 87 is a flat face that is formed on the radially outer side of the rear face 86, such that the rear face 87 is continued from the rear face 86. The rear face 87 is formed along the radial direction thereof.

In the second embodiment, the fore face of the partition wall 54, which is arranged on the rear side of the vane groove 80 in the rotative direction, is constructed of the two fore faces 84, 85. The fore face of the partition wall 54 is bent to the fore side in the radial direction to be in the reentrant shape.

Thereby, the inclination angle of the fore face 84 is changed, so that the angle of bend between the fore face 84 and the fore face 85 can be adjusted. Thus, the angle of flow of fuel relative to the fore face 84 when fuel flows into the vane groove 80 and the angle of flow of fuel when fuel flows out of the vane groove 80 can be individually adjusted.

Figure 9:
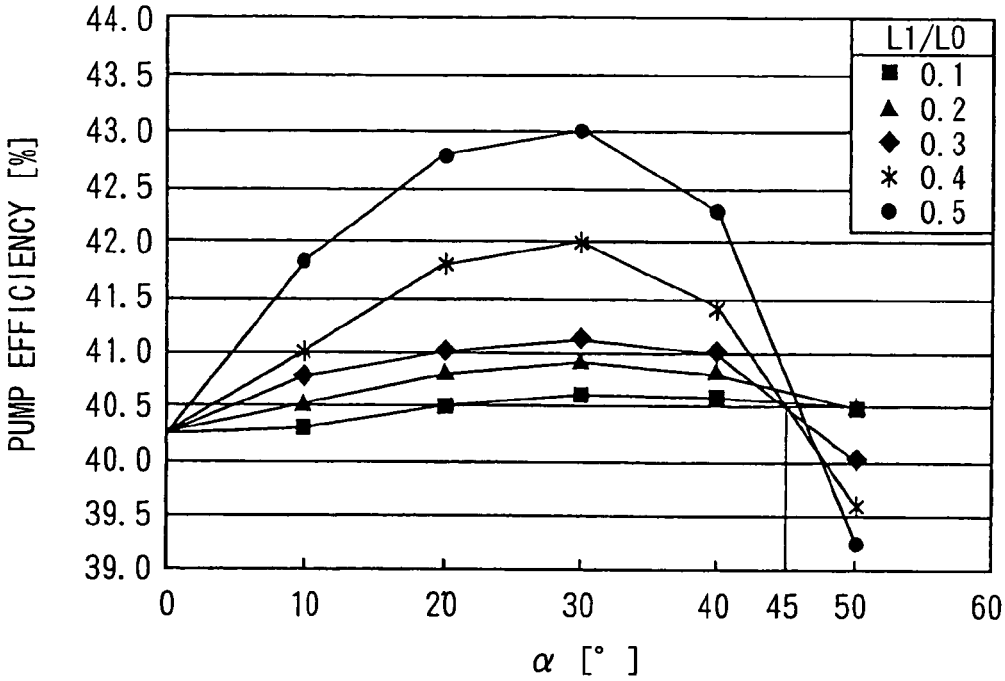
FIG. 9 is a graph showing a relationship between an inclination angle α and pump efficiency.

As shown in FIG. 9. The length of the vane groove 80 in the radial direction is L0, and the length of the fore face 84 in the radial direction is L1. When $\alpha=0°$, the fore face of the partition wall 54 on the radially inner side, which is located on the rear side of the vane groove 80 relative to the rotative direction, is not inclined to the rear side in the rotative direction, as the fore face of the partition wall 54 extends to the radially outer side thereof. That is, the total fore face of the partition wall 54 is formed along the radial direction. According to FIG. 9, when the radially inner side of the fore face of the partition wall 54 is inclined to the rear side relative to the rotative direction on the radially outer side thereof, the inclination angle $\alpha$ is equal to or less than 45°, and L1/L0 is 0.1, 0.2, 0.3, 0.4, 0.5, pump efficiency is enhanced compared with pump efficiency of the structure, in which $\alpha=0°$.

Therefore, when a flat face, which is inclined to the rear side relative to the rotative direction on the radially outer side thereof, is formed on at least radially inner side of the fore face of the partition wall 54, the inclination angle $\alpha$is preferably equal to or less than 45°. The range of the preferable inclination angle $\alpha$ can be applied to the structure, in which the total fore face of the partition wall 54 on the fore side relative to the rotative direction is inclined to the rear side relative to the rotative direction on the radially outer side thereof, as described in the first embodiment.

Figure 10:
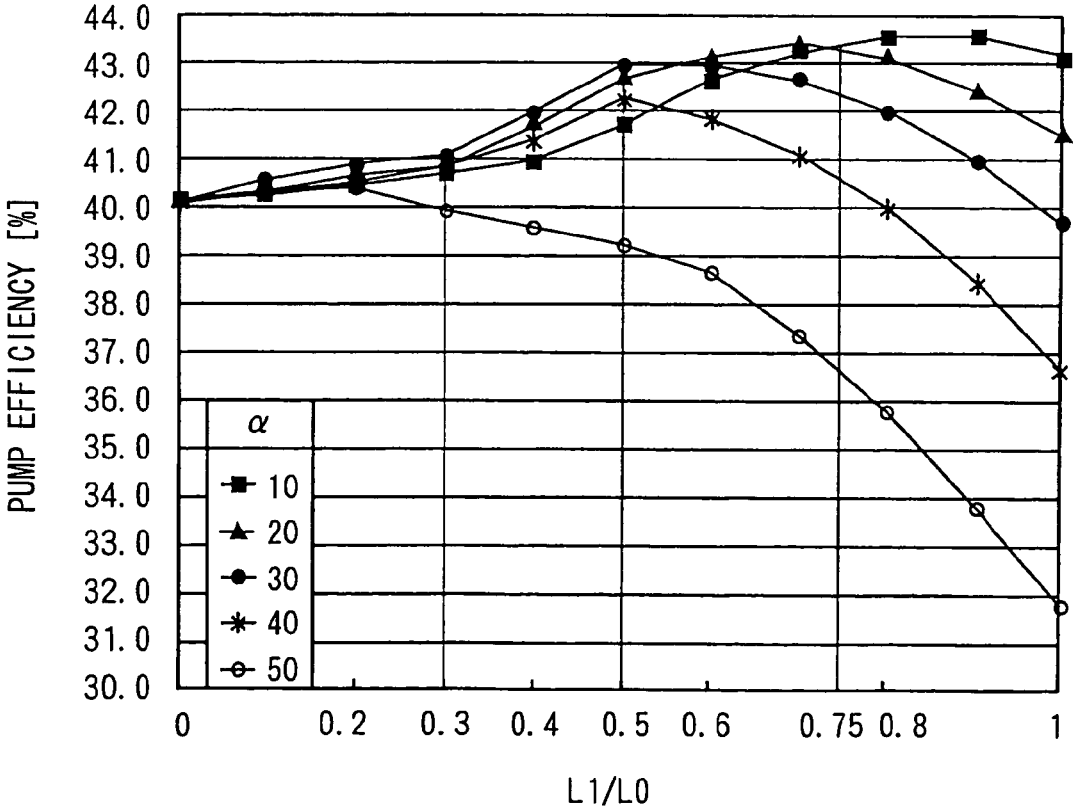
FIG. 10 is a graph showing a relationship between L1/L0 and pump efficiency.

According to FIG. 10, when L1/L0 is equal to or greater than 0.3, pump efficiency is enhanced in particular inclination angles $\alpha$ such as 30°. When L1/L0 is equal to or greater than 0.5, pump efficiency is significantly enhanced in particular inclination angles $\alpha$. When L1/L0 is equal to or less than 0.75, pump efficiency is enhanced in a range, in which $\alpha$ is equal to or less than 40°.

In the second embodiment, an edge portion (intersection) 92, which is between the fore face 85 of the partition wall 54 on the radially outer side and the inner peripheral face 53 of the annular portion 52, is in an angular shape. The edge portion 96, which is between the rear face 87 of the partition wall 54 on the radially outer side and the inner peripheral face 53 of the annular portion 52, is in the angular shape. Additionally, the edge portion 90, which is between the fore face 84 of the partition wall 54 on the radially inner side and the inner peripheral face 88 of the vane groove 56, is in the angular shape. Besides, the edge portion 94, which is between the rear face 86 of the partition wall 54 on the radially inner side and the inner peripheral face 88 of the vane groove 56, is in the angular shape. Thereby, volume of the vane groove 56, an area, through which swirl flow passing into the vane groove 56, and an area, through which swirl flow passing out of the vane groove 56, can be enhanced as much as possible, compared with a structure, in which the edge portions 90, 92, 94, 96 are in arc shapes. Thus, an amount of fuel flowing through the vane groove 56 can be increased as much as possible, and energy of swirl flow can be enhanced. Simultaneously, energy, which is transmitted to fuel in the pump passages, can be further enhanced.

The edge portions 90, 92, 94, 96 are preferably in the angular shapes as described in the second embodiment. However, when an R need to be formed in edge portions 90, 92, 94, 96 due to constraints of manufacturing or the like, R is preferably equal to or less than 0.5 mm.

Variation of Second Embodiment

Figure 11:
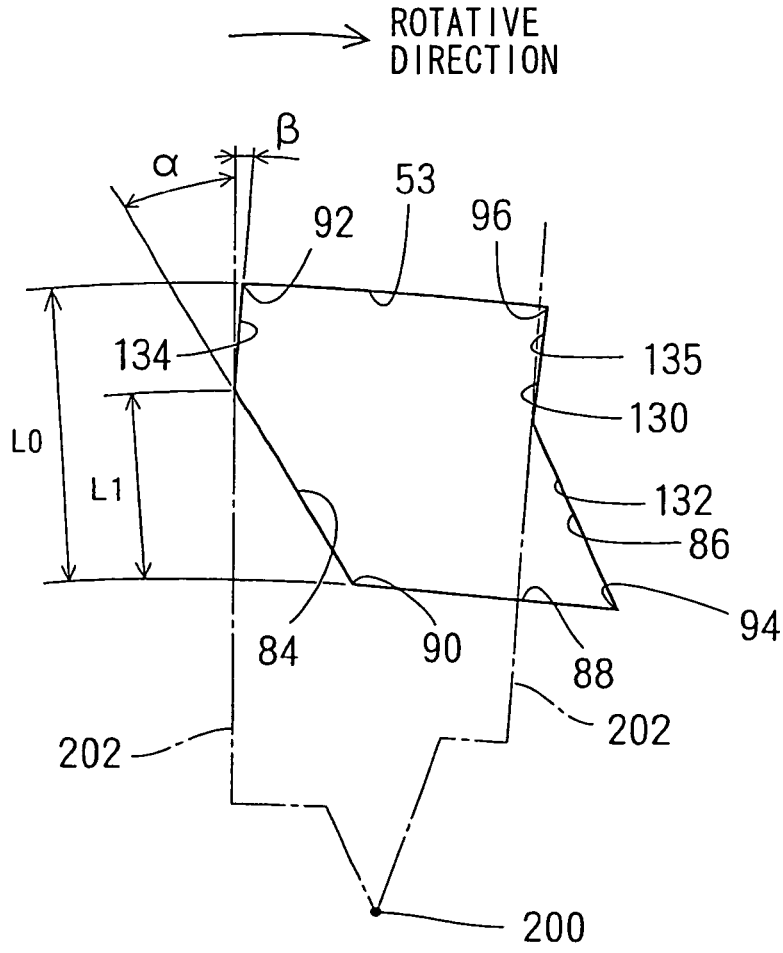
FIG. 11 is a front view showing a vane groove according to a variation of the second embodiment of the present invention.

In the second embodiment, the fore face 85, which is formed on the radially outer side of the fore face 84, is defined along the radial direction. However, as shown in FIG. 11, in the variation of the second embodiment, a vane groove 130 has an inner face 132, in which a fore face 134 is inclined to the fore side in the rotative direction as extending to the radially outer side thereof. The fore face 134 is a flat face formed on the radially outer side of the fore face 84. The fore face 134 is inclined toward the fore side in the rotative direction by an inclination angle $\beta$ with respect to the imaginary line 202. The imaginary line 202 radially extends from the center 200 of the impeller 50 to the radially outer side. The fore face 134 is preferably approximated to the imaginary line 202 that is along the radial direction. Even when the fore face 134 is inclined to both the fore side and the rear side in the rotative direction with respect to the imaginary line 202, the inclination angle $\beta$ is preferably equal to or less than 5°. In this case, the fore face 134, which is located on the radially outer side of the fore face 84, is also preferably inclined to the fore side relative to the rotative direction with respect to the fore face 84, as extending to the radially outer side. That is, the total fore face of the partition wall 54, which includes the fore faces 84, 134, is preferably bent to the fore side relative to the rotative direction to be in a reentrant shape.

The rear face 135 is formed on the radially outer side of the rear face 86 located on the fore side of the vane groove 130 relative to the rotative direction. The rear face 135 is inclined to the fore side in the rotative direction with respect to the imaginary line 202 as extending to the radially outer side thereof, similarly to the fore face 134.

Third Embodiment

In the third embodiment, the fore face of the partition wall 54 on the radially inner side is inclined to the rear side relative to the rotative direction, as extending to the radially outer side, similarly to the structure in the second embodiment.

Figure 12:
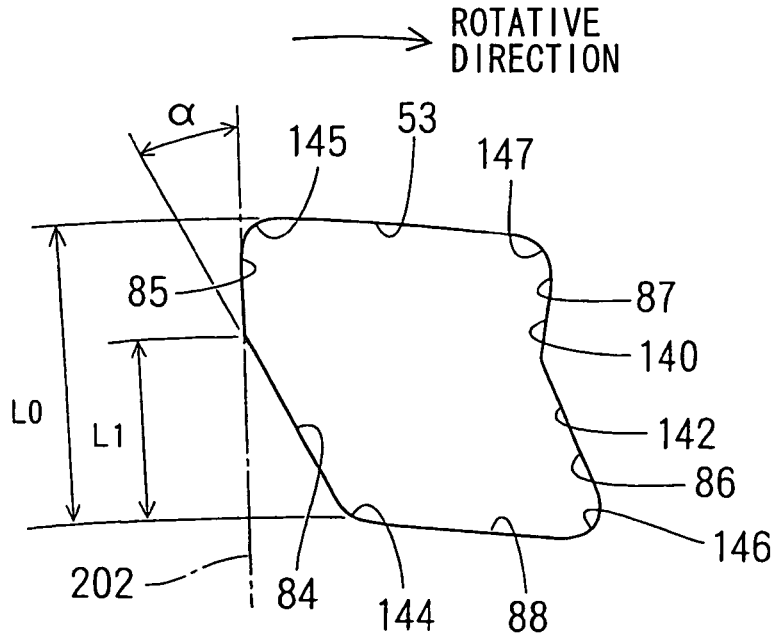
FIG. 12 is a front view showing a vane groove according to a third embodiment of the present invention.

As shown in FIG. 12, a vane groove 140 has an inner face 142. The fore face 84 and the inner peripheral face 88 form an edge portion (intersection) 144, which is in an arc shape, in the intersection therebetween. The rear face 86 and the inner peripheral face 88 form an edge portion (intersection) 146, which is in an arc shape, in the intersection therebetween. The fore face 85 and the inner peripheral face 53 form an edge portion (intersection) 145, which is in an arc shape, in the intersection therebetween. The rear face 87 and the inner peripheral face 53 form an edge portion (intersection) 147, which is in an arc shape, in the intersection therebetween. Each edge portion 144, 145, 146, 147 is not in an angular shape.

Fourth Embodiment

In the fourth embodiment, the fore face of the partition wall 54 on the radially inner side is inclined to the rear side relative to the rotative direction, as extending to the radially outer side, similarly to the structures in the second and third embodiments.

Figure 13:
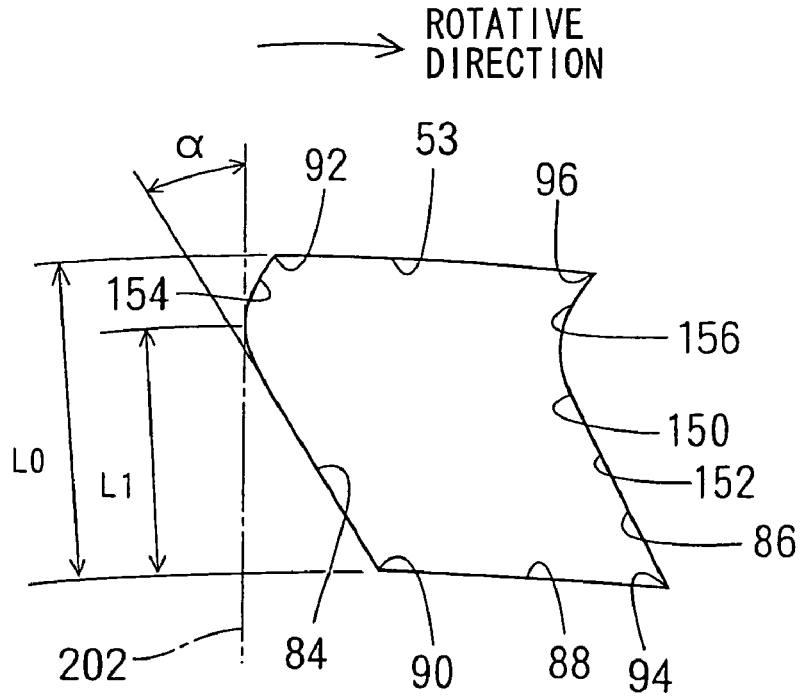
FIG. 13 is a front view showing a vane groove according to a fourth embodiment of the present invention.

As shown in FIG. 13, a vane groove 150 has an inner face 152. A fore face 154 is formed on the radially outer side of the fore face 84. A rear face 156 is formed on the radially outer side of the rear face 86. The fore face 154 and the rear face 156 are inclined to the fore side relative to the rotative direction, as extending to the radially outer side. The fore face 84 and the fore face 154 form a smooth curved face therebetween. The rear face 86 and the rear face 156 form a smooth curved face therebetween.

In particular, the fore face 84 on the radially inner side and the fore face 154 on the radially outer side form the smooth curved face therebetween, on the rear side of the vane groove 150 relative to the rotative direction. Thereby, fuel, which flows into the vane groove 150, flows from the fore face 84 on the radially inner side toward the fore face 154 on the radially outer side through the vane groove 150, while the fuel smoothly changes in flow direction. Thus, flow resistance of fuel flowing through the vane groove 150 can be reduced.

Fifth Embodiment

In the fifth embodiment, the fore face of the partition wall 54 on the radially inner side is inclined to the rear side relative to the rotative direction, as extending to the radially outer side, similarly to the structures in the second, third, and fourth embodiments.

Figure 14:
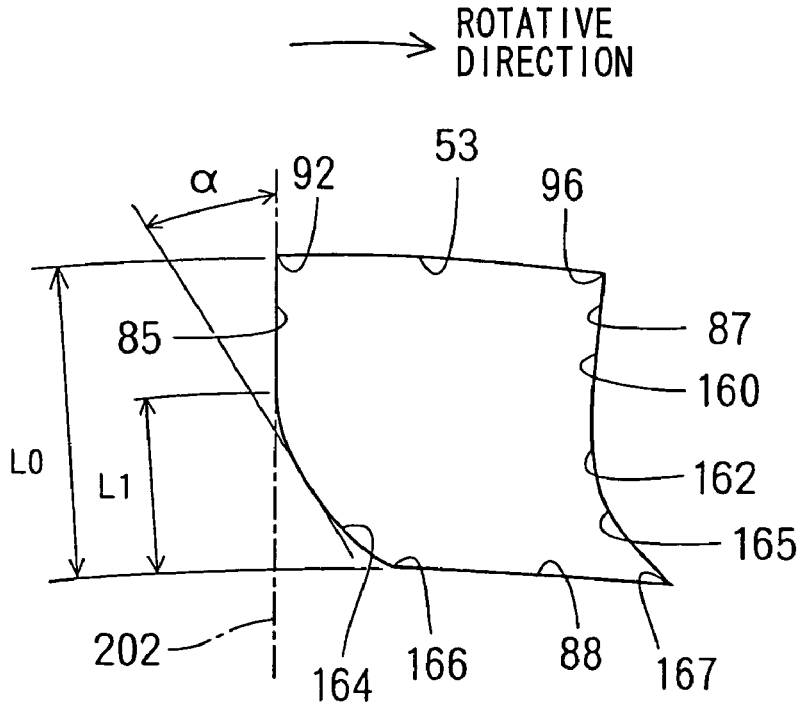
FIG. 14 is a front view showing a vane groove according to a fifth embodiment of the present invention.

As shown in FIG. 14, a vane groove 160 has an inner face 162. The vane groove 160 on the radially inner side thereof has a fore face 164 on the rear side relative to the rotative direction. The vane groove 160 on the radially inner side thereof has a rear face 165 on the fore side relative to the rotative direction. The fore face 164 and the rear face 165 are smooth curved faces, which are inclined to the rear side relative to the rotative direction as extending to the radially outer side. The fore face 164 is an inclined face that is in a reentrant shape. The rear face 165 is an inclined face that is in a salient shape.

The fore face 164 and the fore face 85 are smoothly connected therebetween, and the rear face 165 and the rear face 87 are smoothly connected therebetween. Thereby, fuel, which flows into the vane groove 160, flows from the fore face 164 on the radially inner side toward the fore face 85 on the radially outer side through the vane groove 160, while the fuel smoothly changes in flow direction. Thus, flow resistance of fuel flowing through the vane groove 160 can be reduced.

In the variation of the second embodiment, and in the third, fourth, and fifth embodiments, when L1/L0 is equal to or greater than 0.3, pump efficiency is enhanced in particular inclination angles $\alpha$ of the fore faces 84, 164, which are formed on the radially inner side of the vane groove and are inclined to the rear side relative to the rotative direction. In the structure of the fifth embodiment, the inclination angle $\alpha$ of the fore face 164 is an angle, by which a tangent line of the fore face 164, which is the reentrant curved face, is inclined toward the rear side relative to the rotative direction with respect to the imaginary line 202. The imaginary line 202 radially extends from the center 200 of the impeller 50 to the radially outer side. The inclination angle $\alpha$ is preferably equal to or less than 45°. When L1/L0 is equal to or greater than 0.5, pump efficiency is significantly enhanced in particular inclination angles $\alpha$ of the fore faces 84, 164. Pump efficiency is enhanced in a particular range of the inclination angles $\alpha$ of the fore faces 84, 164, and when L1/L0 is equal to or less than 0.75, the range, in which pump efficiency is enhanced, is enlarged.

In the above embodiments, each partition wall partitions vane grooves, which are adjacent to each other in the rotative direction. The partition wall has a fore face on the fore side relative to the rotative direction. The fore face has one of the inclined flat face and the reentrant curved face on at least radially inner side thereof. The one of the inclined flat face and the reentrant curved face is inclined to the rear side relative to the rotative direction as extending to the radially outer side. Thereby, fuel smoothly flows into the vane groove along the one of the inclined face and the reentrant curved face, which is the fore face of the partition wall located on the rear side of the vane groove relative to the rotative direction. As a result, force, which is applied in the direction opposite to the rotative direction by fuel flowing into the vane groove, is decreased. Thereby, pump efficiency of the fuel pump is enhanced. As a result, when requirement of a fuel discharge amount is the same, an equivalent fuel discharge amount can be produced, even when the fuel pump is small sized. When a body size is the same, a fuel discharge amount can be increased.

In the above structures, the fore face, which is formed in the partition wall 54 on the fore side relative to the rotative direction, has the inclined face on at least radially inner side thereof. The inclined face is inclined to the rear side relative to the rotative direction. In this structure, swirl flow of fuel, which is decreased in energy and is approximated to be in the rotative direction, smoothly enters into the vane groove along the inclined face formed in the fore side of the partition wall 54 on the radially inner side thereof. The partition wall 54 is arranged on the rear side of the vane groove relative to the rotative direction. As a result, colliding force, which is applied to the vane groove by fuel flowing into the vane groove, decreases, so that disturbance of rotation of the impeller 50, which is caused by fuel flowing into the vane groove, can be restricted.

The inclined face formed on the radially inner side of the fore face of the partition wall 54 is inclined by the inclination angle $\alpha$. When the inclination angle $\alpha$ is excessively large, fuel flowing through the vane groove is excessively inclined to the rear side relative to the rotative direction. When the fuel flow, which is excessively inclined to the rear side relative to the rotative direction, is largely changed in direction, energy of swirl flow decreases. That is, when the fuel flow is changed to be swirl flow, and the direction of the fuel flow is largely changed to be along the radial direction, energy of swirl flow decreases. In the above structure, the inclination angle $\alpha$ is set to be equal to or less than 45°, so that colliding force, which is applied to the vane groove in the direction opposite to the rotative direction by fuel flowing into the vane groove, decreases. Furthermore, energy of swirl flow is restricted form decreasing as much as possible, while the direction of fuel flow is returned to be along the radial direction.

In the above structures, the fore face of the inclined face on the radially outer side is inclined to the fore side in the rotative direction with respect to the inclined face. That is, the total fore face of the partition wall 54 is bent to the fore side in the rotative direction to be in a reentrant shape. In this structure, fuel flowing to the rear side in the rotative direction along the inclined face, which is formed in the fore face of the partition wall 54 on the radially inner side, can be changed swirl flow flowing along the radial direction by the fore face of the inclined face on the radially outer side.

In the above structures, the inclined face, which is formed on the fore face of the partition wall 54, has a flat face on the radially outer side. The flat face is defined along the radial direction. In this structure, fuel flows to the radially outer side from the inclined face on the radially inner side thereof formed in the fore face of the partition wall 54, which is located on the rear side of the vane groove in the rotative direction. The fuel smoothly flows from the vane groove to the pump passages 110, 112 along the radial direction by the flat face, which is on the radially outer side. Thereby, energy of swirl flow can be restricted from decreasing.

In the above structures, the rear face formed on the radially inner side of the partition wall 54, which is on the rear side of the partition wall 54 in the rotative direction, is inclined toward the rear side in the rotative direction, corresponding to the inclined face. The inclined face is formed on the radially inner side in the fore face of the partition wall 54. Thereby, a volume of the vane groove and an area, through which swirl flow entering into the vane groove, can be restricted from decreasing, so that an amount of fuel flowing through the vane groove can be restricted from decreasing.

Here, L0 is the length of the vane groove in the radial direction, and L1 is the length of the inclined face in the radial direction. The inclined face is formed on the radially inner side in the fore face of the partition wall 54 to be inclined to the rear side in the rotative direction. Fuel flowing into the radially inner side of the vane groove is guided by the inclined face throughout a length. The length becomes insufficient, when L1/L0 is excessively small. As a result, fuel collides against the fore face, which is located on the radially outer side of the inclined face, before the direction of fuel flowing through the vane groove is changed to be along the inclined face located on the radially inner side in the fore face. Accordingly, large force is applied to the fore face of the partition wall 54 in the direction opposite to the rotative direction of the impeller 50.

Therefore, in the above structures, L1/L0 is set to be equal to or greater than 0.3, so that the length, through which fuel flow is guided by the inclined face, is secured on the radially inner side in the fore face of the partition wall 54. The inclined face is inclined to the rear side in the rotative direction. Thereby, fuel is changed in direction by the inclined face, and the fuel flows to the radially outer side of the inclined face of the fore face. Thus, force, which is applied from fuel flow to the fore face of the partition wall 54 in the direction opposite to the rotative direction, can be decreased as much as possible.

In the above structures, L1/L0 is set to be equal to or greater than 0.5, so that the length, through which fuel flow is guided by the inclined face on the radially inner side in the fore face, is further extended. The inclined face is inclined to the rear side in the rotative direction. Thus, force, which is applied from fuel flow to the fore face of the partition wall 54 in the direction opposite to the rotative direction, can be further decreased.

Here, when L1/L0 is excessively large, the length, through which fuel flow is guided by the inclined face on the radially inner side in the fore face of the partition wall 54, becomes elongated. Here, the inclined face is inclined to the rear side in the rotative direction, as extending to the radially outer side. The direction of fuel flowing out of the vane groove, is returned to the swirl direction on the radially outer side of the inclined face through a length, and the length becomes insufficient when L1/L0 is excessively large. As a result, energy of fuel in the swirl direction decreases. Accordingly, when fuel reenters into the vane groove, an angle, which is defined between the axially end face of the impeller 50 and fuel flow, becomes small. That is, an angle of fuel flowing into the vane groove becomes large with respect to the axis of the impeller 50. As a result, an amount of fuel flowing into the vane groove decreases.

Therefore, in the above structures, L1/L0 is set to be equal to or less than 0.75. Thereby, the upper limit of the ratio of the inclined face, which is inclined to the rear side as extending to the radially outer side, with respect to the fore face of the partition wall 54 is restricted. Therefore, the length of the inclined face is restricted. Thus, the angle of fuel flow, which is introduced into the vane groove, with respect to the axis of the impeller 50 is restricted from being excessively large, so that an amount of fuel flowing into the vane groove is maintained.

In the above structures, the annular portion 52 covers the radially outer side of the vane groove, so that the radially outer side of the vane groove is closed. Differential pressure is generated in fuel in the pump passages 110, 112, which is formed along the vane groove, by rotation of the impeller 50 in the rotative direction. The differential pressure is not directly applied to the outer periphery of the impeller 50, so that pressure of fuel in a gap formed along the outer periphery of the impeller 50 is uniformed. As a result, force applied to the impeller 50 in the radial direction becomes small, so that the impeller 50 is not apt to be misaligned in rotation center thereof.

In the above structures, the fore face of the partition wall 54 on the radially outer side and the inner peripheral face 53 of the annular portion 52 define the intersection, which is in an angular shape, therebetween. The rear face of the partition wall 54 on the radially outer side and the inner peripheral face 53 of the annular portion 52 define the intersection, which is in an angular shape, therebetween. In this structure, volume of the vane groove and an area, through which fuel flowing out of the vane groove, can be enhanced as much as possible, compared with a structure, in which both the fore face and the rear face of the partition wall 54 and the inner peripheral face 53 of the annular portion 52 form intersections in arc-shapes. Thus, an amount of fuel flowing through the vane groove can be increased.

In the above structures, the fore face of the partition wall 54 on the radially inner side and the inner peripheral face of the vane groove define the intersection, which is in an angular shape, therebetween. The rear face of the partition wall 54 on the radially inner side and the inner peripheral face of the vane groove define the intersection, which is in an angular shape, therebetween. In this structure, volume of the vane groove and an area, through which fuel flowing out of the vane groove, can be enhanced as much as possible, compared with a structure, in which both the fore face and the rear face of the partition wall 54 and the inner face of the vane groove form intersections in arc-shapes. Thus, an amount of fuel flowing through the vane groove can be increased.

In the above structures, the impeller 50 having the above structure is used, so that collision force of fuel, which flows into the vane groove, with respect to the vane groove decreases, so that the impeller 50 can be protected from being disturbed in rotation due to fuel flowing into the vane groove. Thereby, pump efficiency can be enhanced.

OTHER EMBODIMENT

The present invention is not limited to the above embodiments. The structure of the present invention may be any structure as long as at least one of the following two conditions is satisfied. The inclined face, which is formed on the at least radially inner side of the fore face of the partition wall, is inclined by the inclination angle $\alpha$ that is equal to or less than 45°. Alternatively, L1/L0 is equal to or greater than 0.3. L0 is the length of the vane groove in the radial direction. L1 is the length of the inclined face in the radial direction. The inclined face is formed at least on the radially inner side of the fore face of the partition wall.

In the above embodiments, the radially outer side of the vane groove is surrounded with the annular portion 52. However, the annular portion 52 need not to be provided, and the vane groove may be opened to the radially outer side thereof.

In the above embodiments, at least radially inner side of the partition wall on the rear side relative to the rotative direction is inclined to the rear side relative to the rotative direction as extending to the outer side, corresponding to the fore face of the partition wall on the radially inner side. However, the rear face of the partition wall may be formed along the radial direction.

In the above embodiments, the coil 24 is wound around the stator core 20 on the circumferentially outer side. Besides, the permanent magnet 36 is provided to the rotor 30, which is on the circumferentially inner side. However, a permanent magnet may be arranged on the circumferentially outer side, and a coil may be wound around a rotor, which is on the inner circumferential side, to construct a fuel pump.

The above structures of the embodiments can be combined as appropriate.

Various modifications and alternations may be diversely made to the above embodiments without departing from the spirit of the present invention.

What is claimed is:

1. An impeller for a fuel pump, the impeller defining a pump passage along a rotative direction of the impeller, the impeller defining the pump passage on both sides in an axial direction of the impeller, the impeller rotating to pressurize fuel in the pump passage, the impeller defining a plurality of vane grooves along the rotative direction, the plurality of vane grooves being respectively on both sides in the axial direction of the impeller, the plurality of vane grooves communicating with the pump passage, the impeller comprising:

a plurality of partition walls, each partitioning the plurality of vane grooves, which are adjacent to each other in the rotative direction, wherein each partition wall includes a fore face on a fore side relative to the rotative direction, the fore face includes an inclined face that is inclined to a rear side relative to the rotative direction at least on a radially inner side thereof, the inclined face is inclined by an inclination angle $\alpha$, and the inclination angle $\alpha$ is equal to or less than 45°, wherein the fore face on the radially outer side of the inclined face is inclined to the fore side relative to the rotative direction with respect to the inclined face, wherein the fore face has a first flat face on the radially outer side of the inclined face, and the first flat face is defined along the radial direction, the impeller further comprising:

an annular portion that connects to the plurality of partition walls, wherein the annular portion surrounds the vane groove on a radially outer side thereof, and each of the plurality of partition walls has a cross section being substantially in a V-shape.

2. The impeller according to claim 1, wherein the fore face on the radially outer side of the inclined face is inclined to one of the fore side and the rear side relative to the rotative direction with respect to an imaginary line, which radially extends from a center of the impeller to the radially outer side, by an inclination angle $\beta$, and the inclination angle $\beta$ is equal to or less than 5°.

3. The impeller according to claim 1, wherein the partition wall has a rear face on the rear side thereof relative to the rotative direction, and the rear face is inclined on the radially inner side thereof to the rear side relative to the rotative direction.

4. The impeller according to claim 1, wherein the vane groove has a length L0 in the radial direction, the inclined face has a length L1 in the radial direction, and the length L0 and the length L1 have a relationship such that L1/L0 is equal to or greater than 0.3.

5. The impeller according to claim 4, wherein the length L0 and the length L1 have a relationship such that L1/L0 is equal to or greater than 0.5.

6. The impeller according to claim 4, wherein the length L0 and the length L1 have a relationship such that L1/L0 is equal to or less than 0.75.

7. The impeller according to claim 1, wherein each partition wall includes a fore face on the fore side thereof relative to the rotative direction, each partition wall includes a rear face on the rear side thereof relative to the rotative direction, the annular portion has an inner peripheral face, the fore face of the partition wall on a radially outer side thereof and the inner peripheral face of the annular portion define an intersection, which is in an angular shape, therebetween, and the rear face of the partition wall on the radially outer side thereof and the inner peripheral face of the annular portion define an intersection, which is in an angular shape, therebetween.

8. The impeller according to claim 7, the vane groove has an inner peripheral face on the radially inner side thereof, the fore face of the partition wall on the radially inner side thereof and the inner peripheral face of the vane groove define an intersection, which is in an angular shape, therebetween, and the rear face of the partition wall on the radially inner side thereof and the inner peripheral face of the vane groove define an intersection, which is in an angular shape, therebetween.

9. A fuel pump comprising:

a motor portion;

the impeller according to claim 1, the impeller being rotated by driving power of the motor portion; and a case member that rotatably accommodates said impeller the case member defining the pump passage.

10. The impeller according to claim 1, wherein the fore face has a second flat face.

11. The impeller according to claim 10, wherein the second flat face is located on the radially inner side of the inclined face.

12. An impeller for a fuel pump, the impeller defining a pump passage along a rotative direction of the impeller, the impeller defining the pump passage on both sides in an axial direction of the impeller, the impeller rotating to pressurize fuel in the pump passage, the impeller defining a plurality of vane grooves along the rotative direction, the plurality of vane grooves being respectively on both sides in the axial direction, the plurality of vane grooves communicating with the pump passage, the impeller comprising:

a plurality of partition walls, each partitioning the plurality of vane grooves, which are adjacent to each other in the rotative direction, wherein the fore face includes an inclined face that is inclined to a rear side relative to the rotative direction at least on a radially inner side thereof, the vane groove has a length L0 in the radial direction, the inclined face has a length L1 in the radial direction, and the length L0 and the length L1 have a relationship such that L1/L0 is equal to or greater than 0.3, wherein the fore face has a first flat face on the radially outer side of the inclined face, and the first flat face is defined along the radial direction, the impeller further comprising:

an annular portion that connects to the plurality of partition walls, wherein the annular portion surrounds the vane groove on a radially outer side thereof, wherein each of the plurality of partition walls has a cross section being substantially in a V-shape.

13. The impeller according to claim 12, wherein the length L0 and the length L1 have a relationship such that L1/L0 is equal to or greater than 0.5.

14. The impeller according to claim 12, wherein the length L0 and the length L1 have a relationship such that L1/L0 is equal to or less than 0.75.

15. The impeller according to claim 12, wherein the fore face on the radially outer side of the inclined face is inclined to one of the fore side and the rear side relative to the rotative direction with respect to an imaginary line, which radially extends from a center of the impeller to the radially outer side, by an inclination angle β, and the inclination angle β is equal to or less than 5°.

16. The impeller according to claim 12, wherein each partition wall includes a fore face on the fore side thereof relative to the rotative direction, each partition wall includes a rear face on the rear side thereof relative to the rotative direction, the annular portion has an inner peripheral face, the fore face of the partition wall on a radially outer side thereof and the inner peripheral face of the annular portion define an intersection, which is in an angular shape, therebetween, and the rear face of the partition wall on the radially outer side thereof and the inner peripheral face of the annular portion define an intersection, which is in an angular shape, therebetween.

17. The impeller according to claim 16, the vane groove has an inner peripheral face on the radially inner side thereof, the fore face of the partition wall on the radially inner side thereof and the inner peripheral face of the vane groove define an intersection, which is in an angular shape, therebetween, and the rear face of the partition wall on the radially inner side thereof and the inner peripheral face of the vane groove define an intersection, which is in an angular shape, therebetween.

18. A fuel pump comprising:

a motor portion;

the impeller according to claim 12, the impeller being rotated by driving power generated by the motor portion; and a case member that rotatably accommodates said impeller, the case member defining the pump passage.

19. The impeller according to claim 12, wherein the fore face has a second flat face.

20. The impeller according to claim 19, wherein the second flat face is located on the radially inner side of the inclined face.

* * * * *